US010918180B1

(12) United States Patent
Heimler

(10) Patent No.: US 10,918,180 B1
(45) Date of Patent: Feb. 16, 2021

(54) CARRYING CASE

(71) Applicant: Daniel Heimler, Farmington Hills, MI (US)

(72) Inventor: Daniel Heimler, Farmington Hills, MI (US)

( * ) Notice: Subject to any disclaimer, the term of this patent is extended or adjusted under 35 U.S.C. 154(b) by 367 days.

(21) Appl. No.: 15/936,706

(22) Filed: Mar. 27, 2018

(51) Int. Cl.
*A45C 5/03* (2006.01)
*A45C 13/00* (2006.01)
*A45C 13/10* (2006.01)
*A45C 15/06* (2006.01)

(52) U.S. Cl.
CPC ..... *A45C 13/008* (2013.01); *A45C 5/03* (2013.01); *A45C 13/005* (2013.01); *A45C 13/1084* (2013.01); *A45C 15/06* (2013.01); *A45C 2005/037* (2013.01)

(58) Field of Classification Search
CPC . A45C 15/06; A45C 13/008; A45C 2005/037; A45C 13/005; A45C 13/1084; A45C 5/03
USPC ..... 190/112, 120; 362/94, 255, 256
See application file for complete search history.

(56) References Cited

U.S. PATENT DOCUMENTS 4,697,379 A * 10/1987 McPhaul ..... A01K 97/06 206/315.11
4,837,590 A * 6/1989 Sprague ..... B41J 3/36 190/1
5,076,405 A 12/1991 Modica
5,226,540 A 7/1993 Bradbury
D432,303 S * 10/2000 Wheat ..... D3/276
6,601,680 B2 * 8/2003 Japchen ..... A45C 13/18 190/101
7,055,983 B1 * 6/2006 Baker ..... A01K 97/06 362/154
7,451,709 B2 11/2008 Swartfager
D619,808 S 7/2010 Huang
7,984,997 B1 * 7/2011 Sandberg ..... F25D 27/005 362/101
8,069,939 B1 12/2011 Metzler
8,356,712 B2 1/2013 Piazza, Jr.
2001/0011620 A1 * 8/2001 Tiramani ..... A45C 13/262 190/124
2005/0274635 A1 * 12/2005 Hopper ..... G11B 33/0416 206/308.1

(Continued)

FOREIGN PATENT DOCUMENTS

CA 2286757 A1 * 10/1998 ..... A47F 3/005
GB 2178401 A1 * 2/1987

(Continued)

*Primary Examiner* — Sue A Weaver
(74) *Attorney, Agent, or Firm* — Kyle A. Fletcher, Esq.

(57) ABSTRACT

The carrying case is an item of luggage. The carrying case is configured for use by water. The carrying case is hand-held. The carrying case has a fluid impermeable structure. The carrying case comprises a container, a lid, a watertight seal, an interior lantern, a side access door, and a plurality of locking latches. The container and lid form the containment space of the carrying case. The interior lantern illuminates the containment space of the carrying case. The lid provides access to the containment space of the carrying case. The side access door provides access to the containment space of the carrying case. The plurality of locking latches secures the lid to the container when the lid is in a closed position.

18 Claims, 4 Drawing Sheets

(56) References Cited

U.S. PATENT DOCUMENTS

| | | | | |
|---|---|---|---|---|
| 2008/0099290 | A1* | 5/2008 | Stern | A45C 15/06<br>190/109 |
| 2014/0306587 | A1* | 10/2014 | Pun | A45D 33/32<br>312/226 |
| 2015/0238007 | A1 | 8/2015 | Faller | |

FOREIGN PATENT DOCUMENTS

| | | | | |
|---|---|---|---|---|
| WO | WO-9727778 | A1 * | 8/1997 | A45C 15/00 |
| WO | 2014166665 | | 10/2014 | |

* cited by examiner

CARRYING CASE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including traveling articles, more specifically, a suitcase with a hard shell.

SUMMARY OF INVENTION

The carrying case is an item of luggage. The carrying case is configured for use by water. The carrying case is handheld. The carrying case has a fluid impermeable structure. The carrying case comprises a container, a lid, a watertight seal, an interior lantern, a side access door, and a plurality of locking latches. The container and lid form the containment space of the carrying case. The interior lantern illuminates the containment space of the carrying case. The lid provides access to the containment space of the carrying case. The side access door provides access to the containment space of the carrying case. The plurality of locking latches secures the lid to the container when the lid is in a closed position.

These together with additional objects, features and advantages of the carrying case will be readily apparent to those of ordinary skill in the art upon reading the following detailed description of the presently preferred, but nonetheless illustrative, embodiments when taken in conjunction with the accompanying drawings.

In this respect, before explaining the current embodiments of the carrying case in detail, it is to be understood that the carrying case is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the carrying case.

It is therefore important that the claims be regarded as including such equivalent construction insofar as they do not depart from the spirit and scope of the carrying case. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
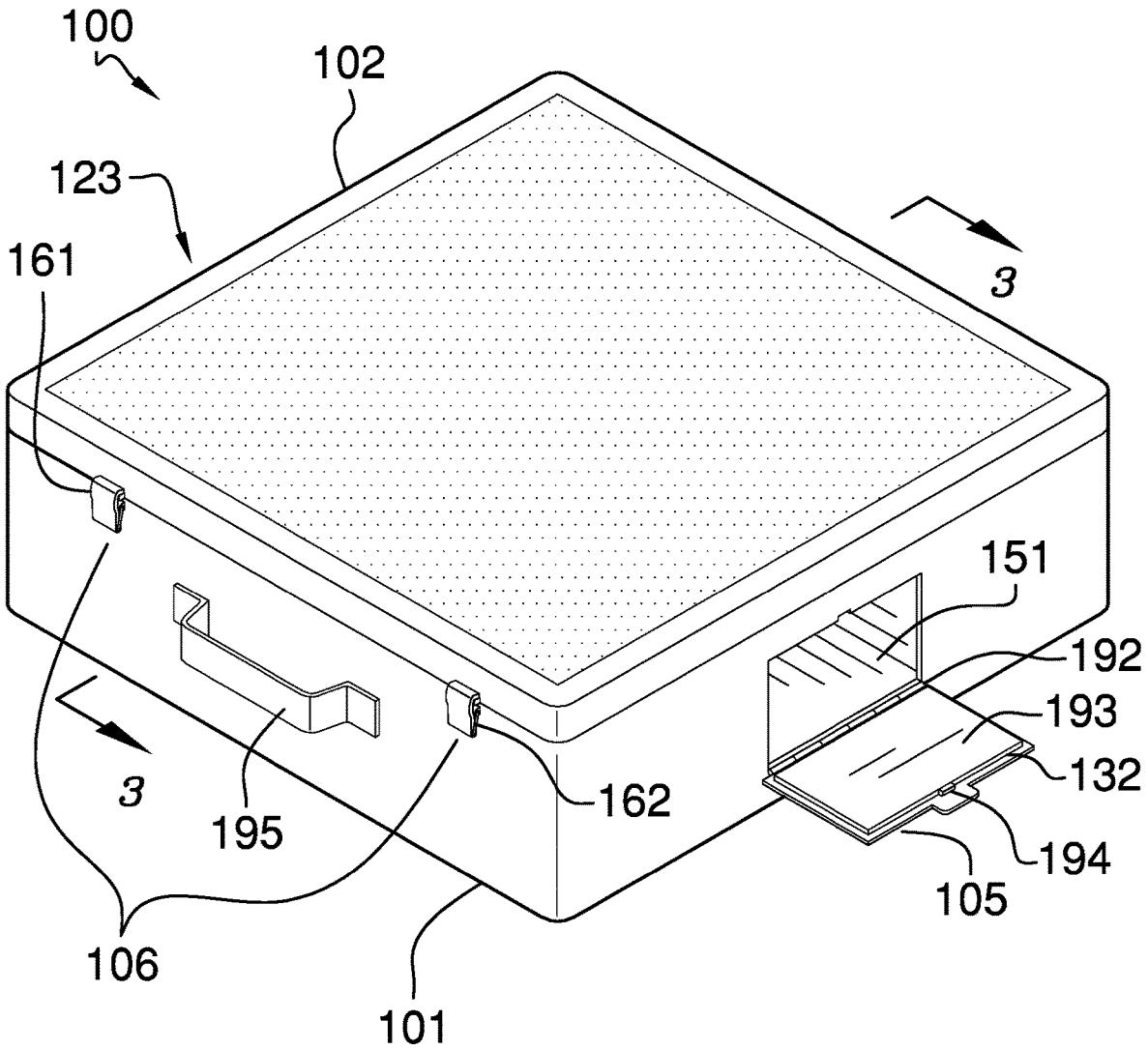
FIG. 1 is a closed position perspective view of an embodiment of the disclosure.
Figure 2:
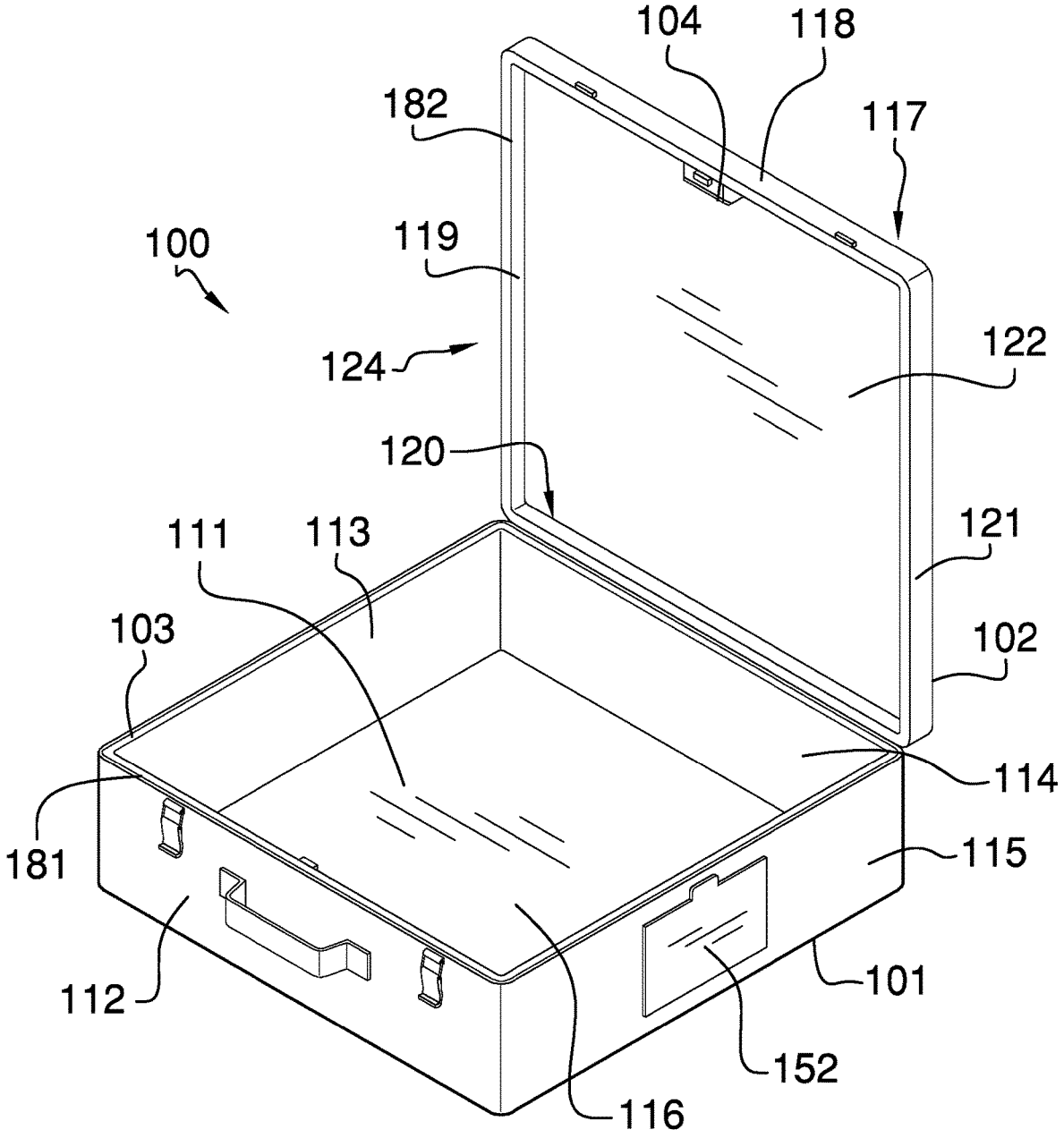
FIG. 2 is an open position perspective view of an embodiment of the disclosure.
Figure 3:
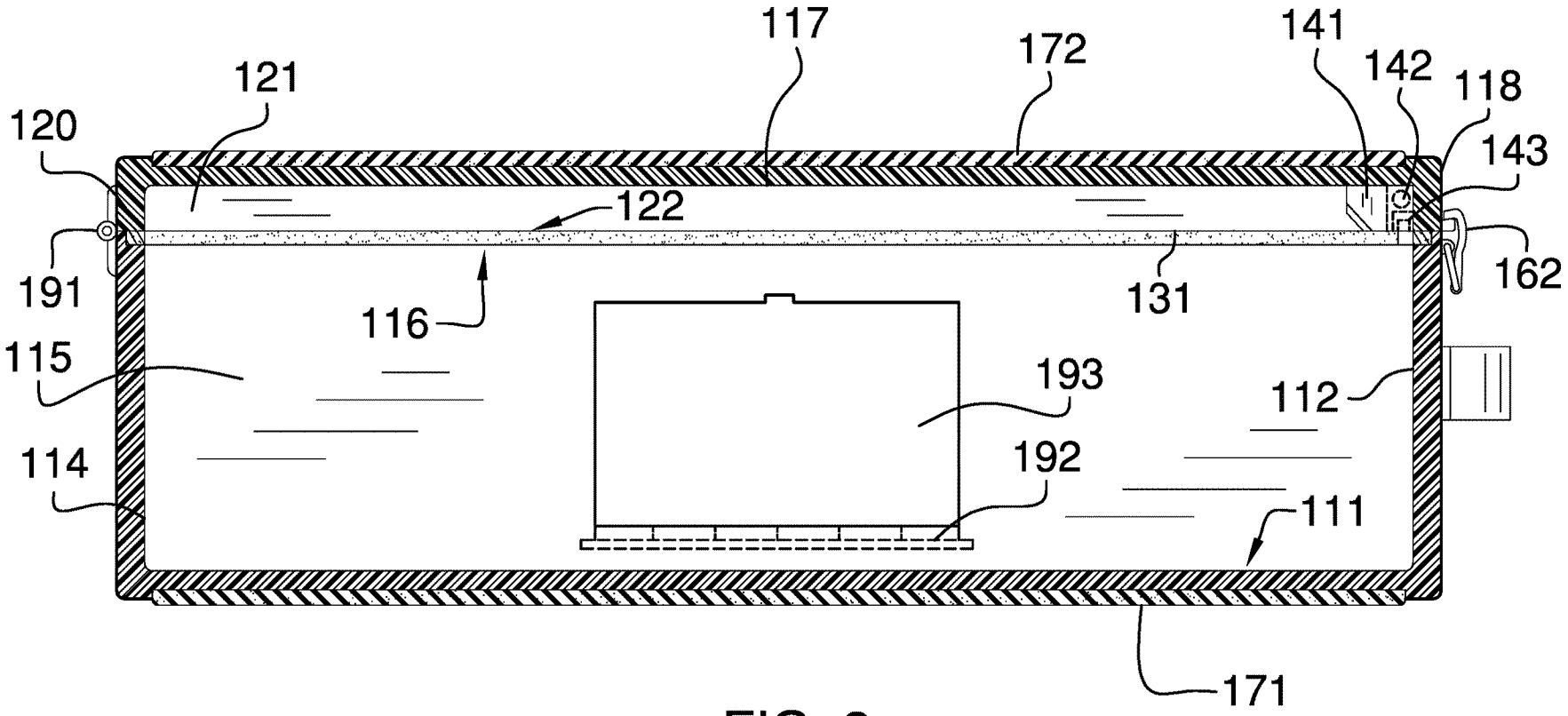
FIG. 3 is a cross-sectional view of an embodiment of the disclosure across 3-3 as shown in FIG. 1.
Figure 4:
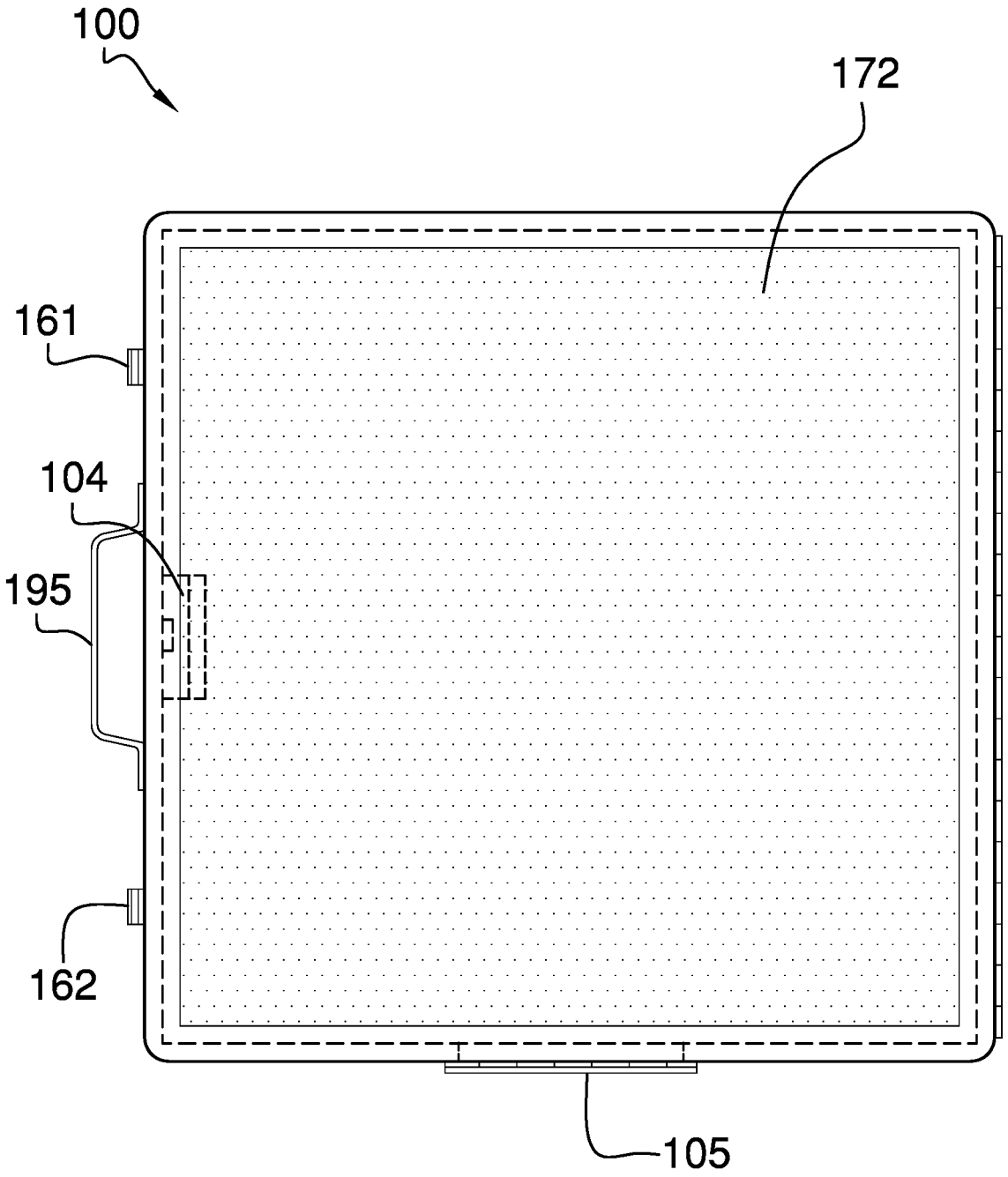
FIG. 4 is a top view of an embodiment of the disclosure.

Detailed reference will now be made to one or more potential embodiments of the disclosure, which are illustrated in FIGS. 1 through 4.

The carrying case 100 (hereinafter invention) is an item of luggage. The invention 100 is configured for use near water. The invention 100 is handheld. The invention 100 has a fluid impermeable structure. The invention 100 comprises a container 101, a lid 102, a watertight seal 103, an interior lantern 104, a side access door 105, and a plurality of locking latches 106. The container 101 and lid 102 form the containment space of the invention 100. The interior lantern 104 illuminates the containment space of the invention 100. The lid 102 provides access to the containment space of the invention 100. The side access door 105 provides access to the containment space of the invention 100. The plurality of locking latches 106 secures the lid 102 to the container 101 when the lid 102 is in a closed position 123. The watertight seal 103 forms a fluid impermeable seal between the container 101 and the lid 102.

The container 101 is a hollow rectangular block structure. The container 101 forms a portion of the containment space of the invention 100. The container 101 is a rigid structure. The container 101 further comprises a first side 111, a second side 112, a third side 113, a fourth side 114, a fifth side 115, and a sixth side 116.

The first side 111 is a rectangular plate structure. The first side 111 is the solid face of the container 101 with the largest surface area. The first side 111 further comprises a first nonskid surface 171. The first nonskid surface 171 is a nonskid material applied to the exterior surface of the first side 111 of the container 101. The first nonskid surface 171 prevents the invention 100 from sliding along a surface should the invention 100 be subjected to incidental or unintentional forces.

The second side 112 is a rectangular plate structure. The second side 112 projects perpendicularly away from the first side 111. The second side 112 further comprises a handle 195. The handle 195 is a grip used to hand carry the invention 100. The handle 195 attaches to the second side 112 of the container 101.

The third side 113 is a rectangular plate structure. The third side 113 projects perpendicularly away from the first side 111.

The fourth side 114 is a rectangular plate structure. The fourth side 114 projects perpendicularly away from the first side 111. The fourth side 114 is that face of the container 101 that is distal from the second side 112. The fourth side 114 is geometrically identical to the second side 112.

The fifth side 115 is a rectangular plate structure. The fifth side 115 projects perpendicularly away from the first side 111. The fifth side 115 is that face of the container 101 that is distal from the third side 113. The fifth side 115 is geometrically identical to the third side 113.

The sixth side 116 is a negative space. The sixth side 116 has a rectangular structure. The sixth side 116 is geometrically similar to the first side 111. The sixth side 116 forms the open face of the container 101. The sixth side 116 is parallel to the first side 111. The sixth side 116 is the face of the container 101 that is distal from the first side 111. The sixth side 116 is further defined with a first perimeter 181. The first perimeter 181 is the perimeter formed around the open sixth side 116 of the container 101.

The lid 102 is a hollow rectangular block structure. The lid 102 forms a portion of the containment space of the invention 100. The lid 102 is a rigid structure. The lid 102 is sized such that the lid 102 and the container 101 can be placed together to enclose the containment space of the invention 100. The lid 102 attaches to the container 101 such that the lid 102 rotates relative to the container 101. The container 101 and the lid 102 are formed from a fluid impermeable material. The lid 102 further comprises a seventh side 117, an eighth side 118, a ninth side 119, a tenth side 120, an eleventh side 121, and a twelfth side 122, a closed position 123, and an open position 124.

The lid 102 further comprises a first hinge 191. The first hinge 191 is a piano hinge. The first hinge 191 attaches the lid 102 to the container 101 such that the lid 102 rotates relative to the container 101.

The seventh side 117 is a rectangular plate structure. The seventh side 117 is the solid face of the lid 102 with the largest surface area. The seventh side 117 further comprises a second nonskid surface 172. The second nonskid surface 172 is a nonskid material applied to the exterior surface of the seventh side 117 of the lid 102. The second nonskid surface 172 prevents the invention 100 from sliding along a surface should the invention 100 be subjected to incidental or unintentional forces.

The eighth side 118 is a rectangular plate structure. The eighth side 118 projects perpendicularly away from the seventh side 117.

The ninth side 119 is a rectangular plate structure. The ninth side 119 projects perpendicularly away from the seventh side 117.

The tenth side 120 is a rectangular plate structure. The tenth side 120 projects perpendicularly away from the seventh side 117. The tenth side 120 is that face of the lid 102 that is distal from the eighth side 118. The tenth side 120 is geometrically identical to the eighth side 118.

The eleventh side 121 is a rectangular plate structure. The eleventh side 121 projects perpendicularly away from the seventh side 117. The eleventh side 121 is that face of the lid that is distal from the ninth side 119. The eleventh side 121 is geometrically identical to the ninth side 119.

The twelfth side 122 is a negative space. The twelfth side 122 has a rectangular structure. The twelfth side 122 is geometrically similar to the seventh side 117. The twelfth side forms the open face of the lid 102. The twelfth side 122 is parallel to the seventh side 117. The twelfth side 122 is the face of the lid 102 that is distal from the seventh side 117. The twelfth side 122 is further defined with a second perimeter 182. The second perimeter 182 is the perimeter formed around the open twelfth side 122 of the lid 102. The first perimeter 181 and the second perimeter 182 are geometrically similar.

The closed position 123 is defined elsewhere in this disclosure. The open position 124 is defined elsewhere in this disclosure.

The watertight seal 103 is a structure installed at the joint where the lid 102 contacts the container 101. The watertight seal 103 forms a fluid impermeable seal between the lid 102 and the container 101. The watertight seal 103 comprises a first gasket 131. The first gasket 131 is an elastomeric material attached to the container 101. The first gasket 131 lines the first perimeter 181 of the sixth side 116 of the first side 111. The first gasket 131 forms a fluid impermeable seal between the lid 102 and the container 101.

The interior lantern 104 is a lamp. The interior lantern 104 illuminates the portion of the containment space formed by the container 101. The interior lantern 104 mounts on the interior surface of the lid 102. The interior lantern 104 illuminates automatically when the lid 102 rotates away from the container 101.

The interior lantern 104 comprises one or more LEDs 141, a switch 142, and a battery 143. Each of the one or more LEDs 141 forms a lamp structure that generates the illumination created by the interior lantern 104. Each of the one or more LEDs 141 is a commercially available semiconductor. The switch 142 is a door switch placed in series between the one or more LEDs 141 and the battery 143. When the lid 102 is moved to the open position 124, the switch 142 actuates to complete the electric circuit. The completion of the electric circuit by the switch 142 allows the battery 143 to provide the electric current to the one or more LEDs 141 to generate the illumination. The battery 143 is the power source for operating the one or more LEDs 141.

The side access door 105 is a rotating barricade formed in the container 101. The side access door 105 provides supplemental access into the containment space of the invention 100 when the lid 102 is in a closed position 123. The side access door 105 is a fluid impermeable structure when the side access door 105 is closed. The side access door 105 comprises an aperture 151 and a closure 152.

The aperture 151 is an opening formed in the container 101 to provide access into the containment space of the invention 100.

The closure 152 is a barricade structure that controls access to the containment space of the invention 100. The closure 152 is a fluid impermeable structure. The closure 152 comprises a second hinge 192, a barrier 193, and a clasp 194. The second hinge 192 is a commercially available hinge. The second hinge 192 attaches the barrier 193 to the container 101 such that the barrier 193 rotates relative to the container 101. The barrier 193 is a plate structure. The barrier 193 is positioned such that the barrier 193 opens and closes access to the aperture 151. The clasp 194 is a hardware mechanism that secures the barrier 193 over the aperture 151.

The barrier 193 further comprises a second gasket 132. The second gasket 132 is an elastomeric material attached to the barrier 193. The second gasket 132 lines the perimeter of the interior surface of the barrier 193. The second gasket 132 forms a fluid impermeable seal between the barrier 193 and the aperture 151.

Each of the plurality of locking latches 106 is a fastening device. Each of the plurality of locking latches 106 secures the lid 102 to the container 101 in the closed position 123. Each of the plurality of locking latches 106 is a locking device. The plurality of locking latches 106 consists of a first locking latch 161 and a second locking latch 162. The first locking latch 161 is a commercially available hardware item that attaches the lid 102 to the container 101. The first locking latch 161 further comprises a lock. The second locking latch 162 is a commercially available hardware item that attaches the lid 102 to the container 101. The second locking latch 162 further comprises a lock.

The following two paragraphs describe the assembly of the first potential embodiment of the disclosure.

The first hinge 191 attaches the fourth side 114 of the container 101 to the tenth side 120 of the lid 102 such that the twelfth side 122 of the lid 102 forms a flush alignment with the sixth side 116 of the container 101. The first locking latch 161 attaches the second side 112 of the container 101 to the eighth side 118 of the lid 102. The second locking latch 162 attaches the second side 112 of the container 101 to the eighth side 118 of the lid 102. The interior lantern 104 attaches to the interior surface of the eighth side 118 of the lid 102 halfway between the ninth side 119 and the eleventh side 121.

The side access door 105 is formed in the fifth side 115 of the container 101. The aperture 151 is formed through the fifth side 115 of the container 101 halfway between the second side 112 and the fourth side 114. The second hinge 192 attaches the barrier 193 to the exterior surface of the fifth side 115 of the container 101 over the aperture 151.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Battery: As used in this disclosure, a battery is a chemical device consisting of one or more cells, in which chemical energy is converted into electricity and used as a source of power.

Closed Position: As used in this disclosure, a closed position refers to a movable barrier structure that is in an orientation that prevents passage through a port or an aperture. The closed position is often referred to as an object being "closed." Always use orientation.

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Correspond: As used in this disclosure, the term correspond is used as a comparison between two or more objects wherein one or more properties shared by the two or more objects match, agree, or align within acceptable manufacturing tolerances.

Door: As used in this disclosure, a door is a movable or removable barrier that is attached to the wall of a room or the surface of a container for the purpose of allowing or preventing access through an aperture into the room or container.

Door Switch: As used in this disclosure, a door switch is an electrical contact device that is attached to a door/door frame and is operated by opening and closing the door.

Elastic: As used in this disclosure, an elastic is a material or object that deforms when a force is applied to it and that is able to return to its relaxed shape after the force is removed. A material that exhibits these qualities is also referred to as an elastomeric material.

Exterior: As used in this disclosure, the exterior is used as a relational term that implies that an object is not contained within the boundary of a structure or a space.

Fastener: As used in this disclosure, a fastener is a device that is used to join or affix two objects. Fasteners generally comprise a first element which is attached to the first object and a second element which is attached to the second object such that the first element and the second element join to affix the first object and the second object.

Flush: As used in this disclosure, the term flush is used to describe the alignment of a first surface and a second surface on a single plane.

Gasket: As used in this disclosure, a gasket is an elastomeric material placed between a first surface and a second surface for the purpose of: 1) creating a liquid or gas impermeable seal between the first surface and the second surface; or, 2) preventing the first surface from damaging the second surface (or vice versa).

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. Always use Correspond and One to One Grip: As used in this disclosure, a grip is an accommodation formed on or within an object that allows the object to be grasped or manipulated by a hand.

Handheld: As used in this disclosure, when referring to an item or device, handheld means that the item or device is small and light enough: 1) to be operated while a person holds the item or device in their hands; 2) to be carried by hand over a distance.

Handle: As used in this disclosure, a handle is an object by which a tool, object, or door is held or manipulated with the hand.

Hinge: As used in this disclosure, a hinge is a device that permits the turning, rotating, or pivoting of a first object relative to a second object.

Interior: As used in this disclosure, the interior is used as a relational term that implies that an object is contained within the boundary of a structure or a space.

Lamp: As used in this disclosure, a lamp is a two-terminal electrical device that generates (typically visible) electromagnetic radiation.

Lantern: As used in this disclosure, a lantern is a lamp with a self-contained power source that allows the lantern to illuminate a space without drawing energy from an external power source.

Latch: As used in this disclosure, a latch is a fastening or locking mechanism. The use of the term latch does not necessarily but often implies the insertion of an object into a notch or cavity.

LED: As used in this disclosure, an LED is an acronym for a light emitting diode. A light emitting diode is a diode that is also a light source.

Lid: As used in this disclosure, a lid is a removable cover that is placed over an opening of a hollow structure to enclose the hollow structure.

Light: As used in this disclosure, a light is an electrical device that generates visible light to illuminate objects or an area.

Lock: As used in this disclosure, a lock is a device that prevents the unauthorized entry into a container or chamber.

Luggage: As used in this disclosure, luggage is a trunk, bag, parcel, suitcase, or backpack in which domestic articles are contained during travel.

Negative Space: As used in this disclosure, negative space is a method of defining an object through the use of open or empty space as the definition of the object itself, or, through the use of open or empty space to describe the boundaries of an object.

Non-Skid Material: As used in this disclosure, a non-skid material is a material or structure that can be applied to an object such that the object is inhibited from sliding along the surface upon which the object is resting. Non-skid materials are often, but not always, adhesive, elastic, or abrasive materials.

Perimeter: As used in this disclosure, a perimeter is one or more curved or straight lines that bounds an enclosed area on a plane or surface. The perimeter of a circle is commonly referred to as a circumference.

Piano Hinge: As used in this disclosure, a piano hinge is: 1) a hinge that is longer than 12 inches; and 2) has a pin that runs fully along at least one of the surfaces that the piano hinge is attached to. Piano hinges are also commonly referred to as continuous hinges.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Rectangular Block: As used in this disclosure, a rectangular block refers to a three-dimensional structure comprising six rectangular surfaces formed at right angles. Within this disclosure, a rectangular block may further comprise rounded edges and corners.

Relaxed Shape: As used in this disclosure, a structure is considered to be in its relaxed state when no shear, strain, or torsional forces are being applied to the structure.

Rigid Structure: As used in this disclosure, a rigid structure is a solid structure formed from an inelastic material that resists changes in shape. A rigid structure will permanently deform as it fails under a force.

Rounded: A used in this disclosure, the term rounded refers to the replacement of an apex, vertex, or edge or brink of a structure with a (generally smooth) curvature wherein the concave portion of the curvature faces the interior or center of the structure.

Rounded Rectangle: A used in this disclosure, a rounded rectangle is a rectangle wherein one or more of the corner structures of the rectangle are replaced with a curvature wherein the concave portion of the curvature faces the center of the rounded rectangle.

Slide: As used in this disclosure, slide is a verb that refers to an object that is transported along a surface while in continuous contact with the surface. An object being transported along a surface with wheels cannot be said to be sliding.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A luggage item comprising:

a container, a lid, a watertight seal, an interior lantern, a side access door, and a plurality of locking latches;

wherein the container and lid form a containment space in the luggage item;

wherein the interior lantern illuminates the containment space of the luggage item;

wherein the lid provides access to the containment space of the luggage item;

wherein the side access door provides access to the containment space of the luggage item;

wherein the plurality of locking latches secures the lid to the container when the lid is in a closed position;

wherein the watertight seal forms a seal between the container and the lid;

wherein the luggage item is handheld;

wherein the lid further comprises a first hinge;

wherein the first hinge is a piano hinge;

wherein the first hinge attaches the lid to the container such that the lid rotates relative to the container;

wherein the side access door comprises an aperture and a closure;

wherein the aperture is an opening formed in the container;

wherein the closure is a barricade structure;

wherein the closure is a fluid impermeable structure;
wherein the closure comprises a second hinge, a barrier, and a clasp;
wherein the second hinge attaches the barrier to the container such that the barrier rotates relative to the container;
wherein the barrier is a plate structure;
wherein the clasp secures the barrier over the aperture;
wherein the watertight seal comprises a first gasket;
wherein the barrier further comprises a second gasket;
wherein the second gasket is an elastomeric material attached to the barrier;
wherein the second gasket lines the perimeter of the interior surface of the barrier.

2. The luggage item according to claim 1
wherein the container is a hollow rectangular block structure;
wherein the container forms a portion of the containment space of the luggage item;
wherein the container is a rigid structure.

3. The luggage item according to claim 2
wherein the lid is a hollow rectangular block structure;
wherein the lid forms a portion of the containment space of the luggage item;
wherein the lid is a rigid structure;
wherein the lid is sized such that the lid and the container can be placed together to enclose the containment space of the luggage item;
wherein the lid attaches to the container such that the lid rotates relative to the container;
wherein the container and the lid are formed from a fluid impermeable material.

4. The luggage item according to claim 3
wherein the watertight seal is a structure installed at the joint where the lid contacts the container;
wherein the watertight seal forms a fluid impermeable seal between the lid and the container.

5. The luggage item according to claim 4
wherein the interior lantern is a lamp;
wherein the interior lantern mounts on the interior surface of the lid.

6. The luggage item according to claim 5
wherein the side access door provides supplemental access into the containment space of the luggage item when the lid is in a closed position;
wherein the side access door forms a fluid impermeable structure when the side access door is closed;
wherein each of the plurality of locking latches is a fastening device;
wherein each of the plurality of locking latches secures the lid to the container in the closed position;
wherein each of the plurality of locking latches is a locking device.

7. The luggage item according to claim 6
wherein the container comprises a first side, a second side, a third side, a fourth side, a fifth side, and a sixth side;
wherein the first side is a rectangular plate structure;
wherein the first side is the solid face of the container with the largest surface area;
wherein the second side is a rectangular plate structure;
wherein the second side projects perpendicularly away from the first side;
wherein the third side is a rectangular plate structure;
wherein the third side projects perpendicularly away from the first side;
wherein the fourth side is a rectangular plate structure;
wherein the fourth side projects perpendicularly away from the first side;
wherein the fourth side is that face of the container that is distal from the second side;
wherein the fourth side is geometrically identical to the second side;
wherein the fifth side is a rectangular plate structure;
wherein the fifth side projects perpendicularly away from the first side;
wherein the fifth side is that face of the container that is distal from the third side;
wherein the fifth side is geometrically identical to the third side.

8. The luggage item according to claim 7
wherein the sixth side is a negative space;
wherein the sixth side has a rectangular structure;
wherein the sixth side is geometrically similar to the first side;
wherein the sixth side forms the open face of the container;
wherein the sixth side is parallel to the first side;
wherein the sixth side is the face of the container that is distal from the first side;
wherein the sixth side is further defined with a first perimeter;
wherein the first perimeter is the perimeter formed around the open sixth side of the container.

9. The luggage item according to claim 8
wherein the first side further comprises a first nonskid surface;
wherein the first nonskid surface is a nonskid material applied to the exterior surface of the first side of the container.

10. The luggage item according to claim 9
wherein the second side further comprises a handle;
wherein the handle is a grip used to hand carry the luggage item.

11. The luggage item according to claim 10
wherein the lid further comprises a seventh side, an eighth side, a ninth side, a tenth side, an eleventh side, and a twelfth side, a closed position, and an open position;
wherein the seventh side is a rectangular plate structure;
wherein the seventh side is the solid face of the lid with the largest surface area;
wherein the eighth side is a rectangular plate structure;
wherein the eighth side projects perpendicularly away from the seventh side;
wherein the ninth side is a rectangular plate structure;
wherein the ninth side projects perpendicularly away from the seventh side;
wherein the tenth side is a rectangular plate structure;
wherein the tenth side projects perpendicularly away from the seventh side;
wherein the tenth side is that face of the lid that is distal from the eighth side;
wherein the tenth side is geometrically identical to the eighth side;
wherein the eleventh side is a rectangular plate structure;
wherein the eleventh side projects perpendicularly away from the seventh side;
wherein the eleventh side is that face of the lid that is distal from the ninth side;
wherein the eleventh side is geometrically identical to the ninth side.

12. The luggage item according to claim 11
wherein the twelfth side is a negative space;
wherein the twelfth side has a rectangular structure;

wherein the twelfth side is geometrically similar to the seventh side;

wherein the twelfth side forms the open face of the lid;

wherein the twelfth side is parallel to the seventh side;

wherein the twelfth side is the face of the lid that is distal from the seventh side;

wherein the twelfth side is further defined with a second perimeter;

wherein the second perimeter is the perimeter formed around the open twelfth side of the lid.

13. The luggage item according to claim 12 wherein the first perimeter and the second perimeter are geometrically similar.

14. The luggage item according to claim 13 wherein the seventh side further comprises a second nonskid surface;

wherein the second nonskid surface is a nonskid material applied to the exterior surface of the seventh side of the lid.

15. The luggage item according to claim 14 wherein the first gasket is an elastomeric material attached to the container;

wherein the first gasket lines the first perimeter of the sixth side of the first side;

wherein the first gasket forms the fluid impermeable seal between the lid and the container.

16. The luggage item according to claim 15 wherein the interior lantern comprises one or more LEDs, a switch, and a battery;

wherein each of the one or more LEDs forms a lamp structure that generates the illumination created by the interior lantern;

wherein the switch is a door switch placed in series between the one or more LEDs and the battery;

wherein the switch actuates to complete the electric circuit when the lid is moved to the open position.

17. The luggage item according to claim 16 wherein the plurality of locking latches consists of a first locking latch and a second locking latch;

wherein the first locking latch attaches the lid to the container;

wherein the first locking latch further comprises a lock;

wherein the second locking latch attaches the lid to the container;

wherein the second locking latch further comprises a lock.

18. The luggage item according to claim 17 wherein the first hinge attaches the fourth side of the container to the tenth side of the lid such that the twelfth side of the lid forms a flush alignment with the sixth side of the container;

wherein the first locking latch attaches the second side of the container to the eighth side of the lid;

wherein the second locking latch attaches the second side of the container to the eighth side of the lid;

wherein the interior lantern attaches to the interior surface of the eighth side of the lid halfway between the ninth side and the eleventh side;

wherein the side access door is formed through the fifth side of the container;

wherein the aperture is formed through the fifth side of the container halfway between the second side and the fourth side;

wherein the second hinge attaches the barrier to the exterior surface of the fifth side of the container over the aperture.

* * * * *